United States Patent [19]

Leveckis et al.

[11] 4,204,105

[45] May 20, 1980

[54] MICROWAVE ENERGY MODERATING BAG

[75] Inventors: Algis S. Leveckis, Ludlow, Ky.; Stephanie S. Gelman, Cincinnati, Ohio

[73] Assignee: The Procter & Gamble Company, Cincinnati, Ohio

[21] Appl. No.: 896,421

[22] Filed: Apr. 14, 1978

[51] Int. Cl.[2] ..... H05B 9/06

[52] U.S. Cl. ..... 219/10.55 E; 99/451; 426/107

[58] Field of Search ..... 219/10.55 E, 10.55 M, 219/10.55 R, 10.55 F; 426/107, 113, 124, 234, 241, 243, 392, 396, 412; 229/3.5 MF; 99/451; 220/450; 126/390

[56] References Cited

U.S. PATENT DOCUMENTS

| | | | |
|---|---|---|---|
| 3,219,460 | 11/1965 | Brown | 219/10.55 E X |
| 3,269,639 | 8/1966 | Cash | 229/3.5 MF |
| 3,353,968 | 11/1967 | Krajewski | 219/10.55 E |
| 3,410,700 | 11/1968 | Gstohl | 426/107 |
| 3,490,580 | 1/1970 | Brumfield et al. | 219/10.55 E |
| 3,547,661 | 12/1970 | Stevenson . | |
| 3,551,090 | 12/1970 | Brumfield et al. | 219/10.55 E |
| 3,615,711 | 10/1971 | Markus | 426/107 X |
| 3,672,916 | 6/1972 | Virnig . | |
| 3,835,281 | 9/1974 | Mannix | 219/10.55 E |
| 3,865,301 | 2/1975 | Pothier et al. | 219/10.55 E |
| 3,873,735 | 3/1975 | Chalin et al. | 426/107 X |
| 4,013,798 | 3/1977 | Goltsos | 426/107 |
| 4,015,085 | 3/1977 | Woods | 219/10.55 E |
| 4,038,425 | 7/1977 | Brandberg et al. | 426/107 |

*Primary Examiner*—Arthur T. Grimley
*Attorney, Agent, or Firm*—Thomas J. Slone; John V. Gorman; Richard C. Witte

[57] ABSTRACT

An improved microwave energy moderating cooking bag for enclosing, for instance, a food stuff such as a beef roast so that it can be cooked at a relatively high, constant level of power in a microwave energy field (eg; in a microwave oven) to a predetermined degree of doneness without needing to periodically reposition the roast to achieve uniform doneness. The improved bag is of the type having microwave enery moderating wall portions which comprise perforated electrically conductive sheet material: for example, aluminum foil.

The bag is improved by virtue of having adjacent side-by-side segments of the perimetrical edges of the electrically conductive sheet material sufficiently offset with respect to each other to virtually obviate edge-to-edge electric field relations. That is, sufficiently offset to precipitate edge-to-surface electric field relations as opposed to edge-to-edge electric field relations.

4 Claims, 7 Drawing Figures

MICROWAVE ENERGY MODERATING BAG

FIELD OF THE INVENTION

The present invention generally pertains to providing a bag for enclosing foodstuff such as a beef roast to be cooked in a microwave oven and which bag will sufficiently moderate and/or attenuate the microwave energy in the oven to provide a high degree of doneness uniformity to the foodstuff. More specifically, the present invention provides an improved microwave energy moderating cooking bag wherein adjacent side-by-side perimetrical edge portions of electrically conductive sheet elements of the bag are sufficiently offset to substantially obviate edge-to-edge electric field relations.

BACKGROUND OF THE INVENTION

A microwave energy moderating bag is disclosed and claimed in Continuation-In-Part Application Ser. No. 854,941 which was filed on Nov. 25, 1977, and which is hereby incorporated by reference. Such a bag comprises electrically conductive material such as a sheet of aluminum foil which foil may, under some circumstances, precipitate spontaneous electrical arcing when disposed in a microwave energy field. The tendency to so precipitate arcing is believed to be aggravated by the formation of high intensity electric fields adjacent thin edges, rough edges, and sharp corners of electrically conductive members disposed in a field of microwave energy. Intense electric fields also tend to be formed between closely spaced thin edges of such electrically conductive members. The present invention is directed towards substantially obviating such high intensity electric fields intermediate closely spaced thin edges.

Some embodiments of microwave energy moderating bags and various details thereof are shown in FIGS. 14 through 16 and FIGS. 33 through 48 of the above referenced continuation-in-part application. Briefly, as compared to those bag constructions, the present invention is an improved microwave energy cooking bag which comprises electrically conductive sheet materials having perimetrical edges, and in which bag the sheet materials are so configured and disposed that adjacent side-by-side portions of the perimetrical edges are sufficiently offset to virtually obviate or substantially diminish edge-to-edge electric field relations. That is, such offsetting precipitates edge-to-surface relations which have substantially less electric field concentration effects than edge-to-edge relations.

SUMMARY OF THE INVENTION

In accordance with one aspect of the present invention, an improved microwave energy cooking bag is provided which bag is of the type having microwave energy moderating wall portions and in which bag such wall portions include perforate electrically conductive sheet materials having perimetrical edges and having some face-to-face areas. In the improved bag, the electrically conductive sheet materials are so configured and disposed that adjacent side-by-side segments of the perimetrical edges are offset with respect to each other. The degree of offset is sufficient to substantially obviate intense edge-to-edge electric field relations intermediate adjacent side-by-side segments of the perimetrical edges.

BRIEF DESCRIPTION OF THE DRAWINGS

While the specification concludes with claims particularly pointing out and distinctly claiming the subject matter regarded as forming the present invention, it is believed the invention will be better understood from the following description taken in conjunction with the accompanying drawings in which:

DESCRIPTION OF THE PREFERRED EMBODIMENT

Figure 1:
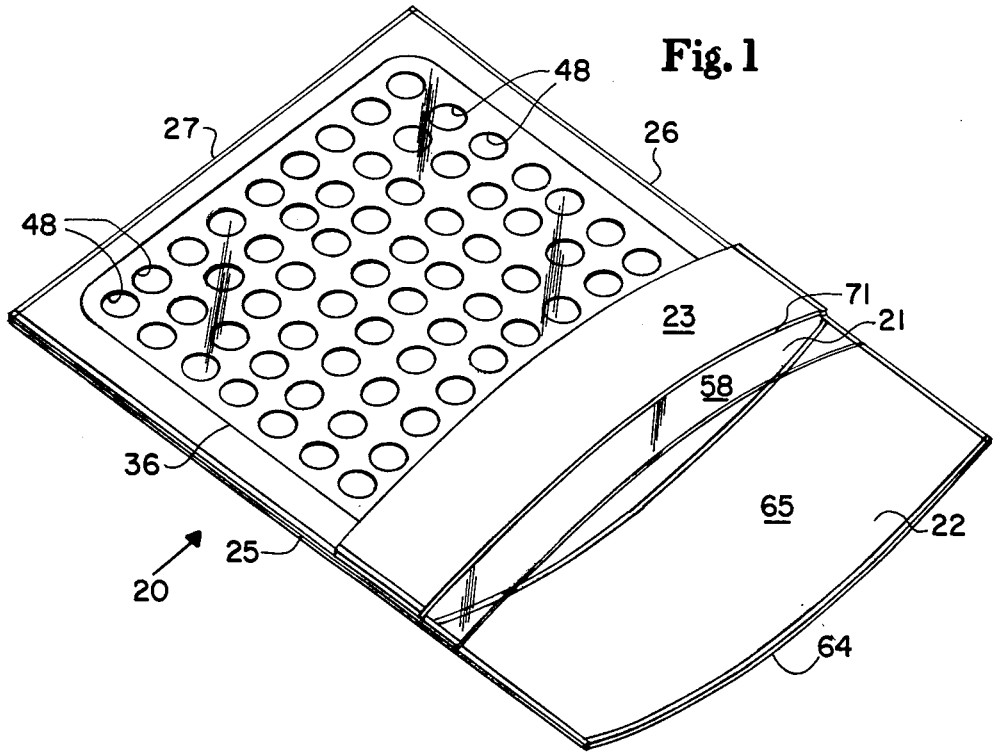
FIG. 1 is a perspective view of a partially opened bag which bag embodies the present invention.

An exemplary, laminated, microwave energy cooking bag 20 which embodies the present invention is shown in FIG. 1. Bag 20 comprises a laminated front panel 21, a laminated back panel 22, and a closure strap 23. The front panel 21, and the back panel 22, are heat sealed together to form side edge seams 25 and 26, and the bottom edge seam 27. The strap 23, is secured transverse the front panel 21 by having its oppositely disposed ends integrally heat welded along segments of side edge seams 25 and 26.

Figure 2:
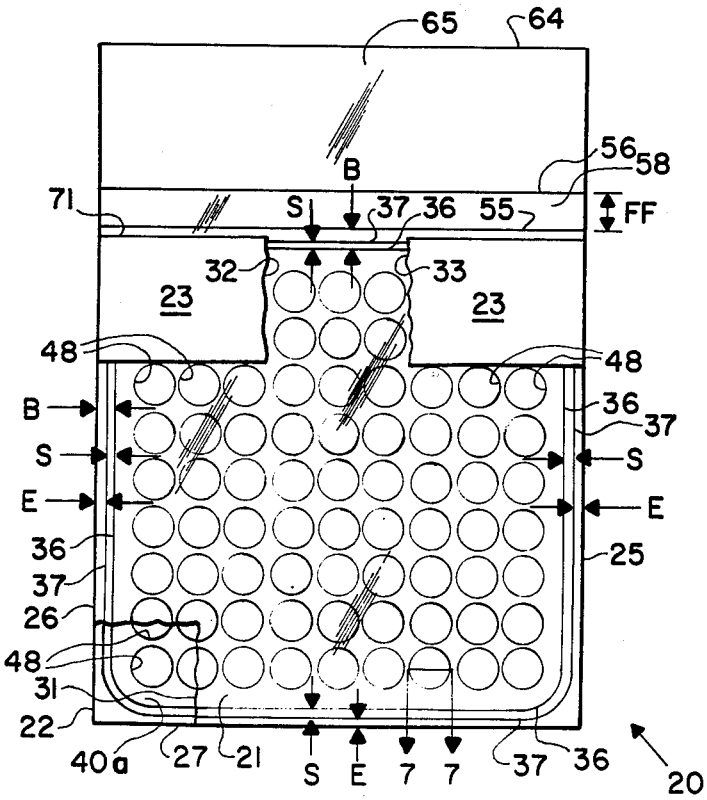
FIG. 2 is a partially torn away, frontal view of the bag shown in FIG. 1.

FIG. 2 is a frontal view of the bag 20 shown in FIG. 1 which bag 20 has the lower left corner of the front panel 21 torn away along line 31, and the central portion of strap 23 torn away along lines 32 and 33. The front panel 21 and the back panel 22 each comprise a sheet of electrically conductive material such as aluminum foil, which sheets have their perimetrical edges designated 36 and 37, respectively. Perimetrical edge 37 is spaced a distance "S" outwardly from edge 36 about the entire perimeters of their respective sheets of conductive material. That is, all of the adjacent side-by-side segments of the two perimetrical edges 36 and 37 are spaced or offset a distance S with respect to each other. Further details of the bag 20 as shown in FIGS. 1 and 2 will be described after the constructions of the front panel 21, FIGS. 4 and 5, and the back panel 22, FIG. 6, are described below.

Figure 3:
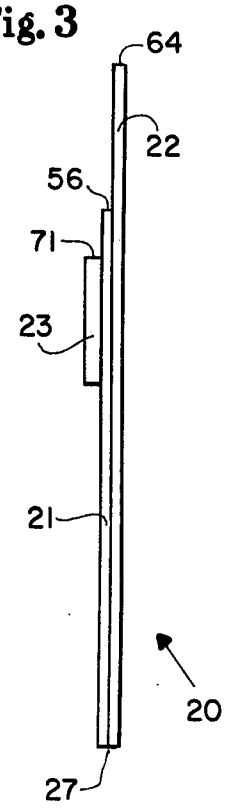
FIG. 3 is a somewhat schematic side view of the bag shown in FIG. 2.

FIG. 3 is a somewhat schematic side view of the bag 20 shown in FIG. 2 inasmuch as the relative thicknesses of the front panel 21, back panel 22, and strap 23, are exaggerated for clarity. Moreover, also for clarity, the discrete laminae of front panel 21 and back panel 22 are not shown in FIG. 3.

Figure 4:
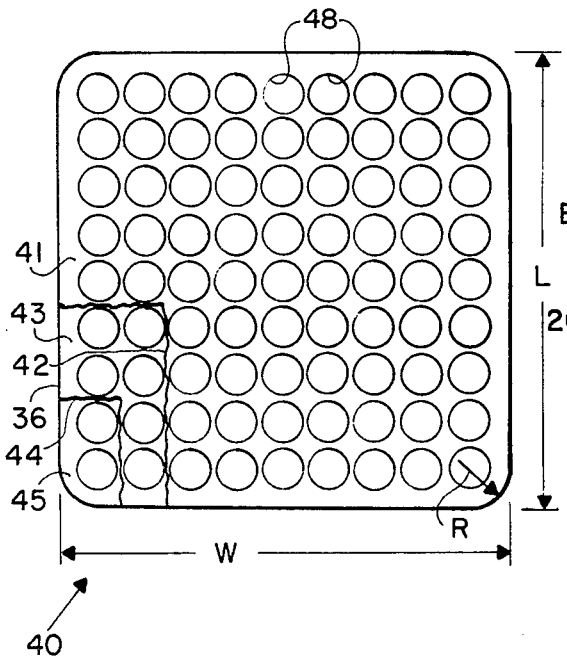
FIG. 4 is a plan view of a perforated sheet of a laminated material comprising an electrically conductive lamina which sheet is a member of the bag structure shown in FIGS. 1 and 2.

FIG. 4 is a plan view of a laminate 40 of length L and width W. Three laminae or plies of laminate 40 are designated 41, 43, and 45. As shown in FIG. 4, the lower left corner of the top lamina 41 is torn away along line 42, and the lower left corner of the middle lamina 43 is torn away along line 44. The torn away portions expose the lower left corner of the bottom lamina 45.

The middle lamina 43 is a sheet or layer of electrically conductive material and laminae 41 and 45 are sheets or layers of electrically insulative material. The laminate 40 is perforated by an array of apertures 48 which array, as shown in the figures, is a nine-by-nine array consisting of eighty-one (81) apertures 48. In an exemplary embodiment of the present invention, laminae 41 and 45 are one-and-one-half mil opaque polypropylene, and lamina 43 is a one-mil sheet of aluminum foil. The lamina 41, 43, and 45 are laminated together by thin layers of extruded polyethylene which layers are not discretely shown in FIG. 4. Thus, laminate 40 is in fact a five layer construction comprising three principal laminae; 41, 43 and 45.

Laminate 40, FIG. 4, of the exemplary embodiment bag 20 is approximately thirty-and-one-half (30.5) cm square with rounded corners of radius R of about two-and-one-half (2.5) cm, and the array comprises round apertures 48 having diameters of about two-and-one-half (2.5) cm. The apertures 48 are disposed about three-and-two-tenths (3.2) cm between centers in an orthogonal pattern. The array of apertures 48 is also centrally disposed with respect to the planform of laminate 40. The perimetrical edge of lamina 43 is designated 36 and is coincident with the perimetrical edge of laminate 40, FIG. 4.

Figure 5:
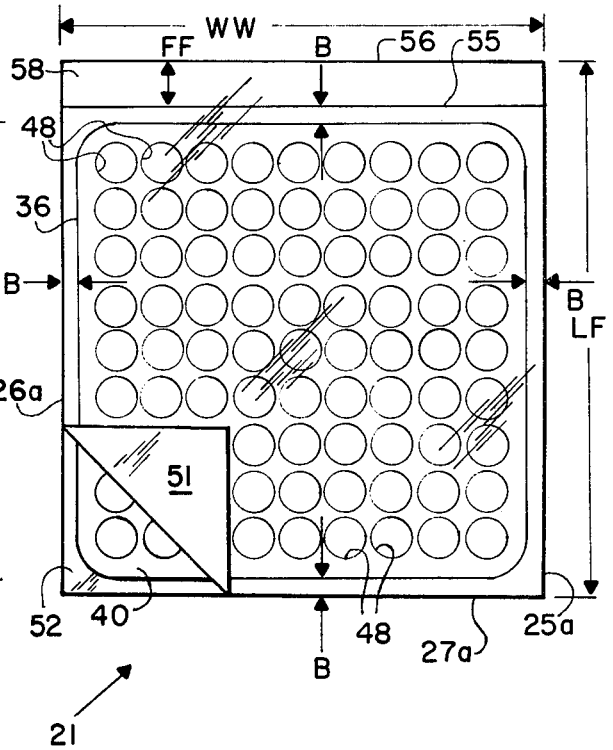
FIG. 5 is a partially peeled apart frontal view of the laminated front wall of the bag shown in FIGS. 1 and 2.
Figure 6:
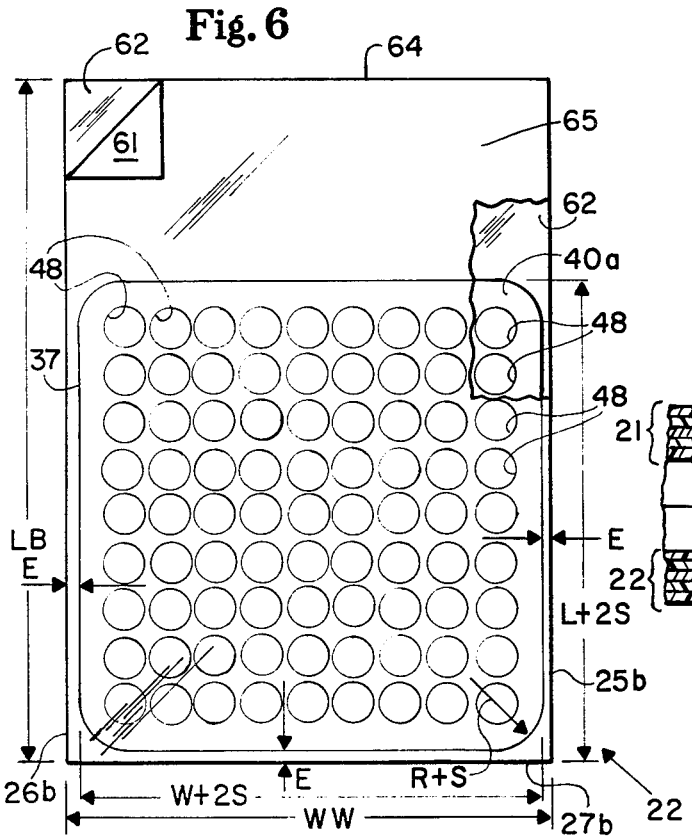
FIG. 6 is a partially peeled apart and partially torn away view of the laminated back wall of the bag shown in FIGS. 1 and 2.

FIG. 5 is a plan view of a partially peeled apart, exemplary front panel 21 which, in combination with a back panel 22, FIG. 6, and a strap 23 can be converted into a bag 20, FIGS. 1 and 2.

As shown in FIG. 5, front panel 21 is a multilayer construction comprising a laminate 40, FIG. 4, disposed intermediate two plies or laminae 51 and 52 of an electrically insulative, moisture barrier or moisture resistant material such as transparent, imperforate, one-mil polypropylene film. The transparent laminae 51 and 52 have lengths LF and widths WW which are greater than L and W, respectively, of laminate 40, FIG. 4. In an exemplary embodiment front panel 21, WW is about thirty-three-and-one-half (33.5) cm which is about three (3 ) cm greater than W, the width of laminate 40, and LF is about thirty-six-and-one-half (36.5) cm which is about six (6) cm greater than L, the length of laminate 40. The laminate 40 and the laminae 51 and 52 are secured together in face-to-face relation by, for instance, heat sealing them together so that laminae 51 and 52 extend a distance B beyond the side and bottom edges of laminate 40. Then, a bar seal 55 is made parallel to the top edge of laminate 40 and spaced a distance B therefrom. In the exemplary front panel 21 described above, distance B is preferably about one-and-one-half ($1\frac{1}{2}$) cm. The side edges of front panel 21 are designated 25*a* and 26*a*; the bottom edge of front panel 21 is designated 27*a*, and its top edge is designated 56. The bar seal 55 forms a closure fold line described hereinafter. A 2-ply portion (laminae 51 and 52) of the front panel 21 extends upwardly a distance FF above bar seal 55. This is designated flap 58.

The back panel 22, FIG. 6, comprises a laminate 40*a* disposed intermediate two laminae 61 and 62 of, preferably, transparent electrically insulative material having a low dielectric loss property such as, for instance, one-mil polypropylene.

Laminate 40*a* is substantially identical to laminate 40, FIG. 4, except 40*a* is two times a distance S wider and two times a distance S longer than laminate 40. Also, the radii of the corners are R+S. The array of apertures 48 in laminate 40*a* is centrally disposed and is identical to the array in laminate 40: ie, two-and-one-half (2.5) cm diameter apertures 48 which are spaced about three-and-two-tenths (3.2) cm between centers. Thus, when laminate 40 is positioned on laminate 40*a* so that the arrays are in registration, a peripheral border portion of uniform width S of laminate 40*a* extends all the way around laminate 40. That is, all of the segments of perimetrical edge 37 of laminate 40*a* are spaced outwardly or offset a distance S with respect to the adjacent, side-by-side segments of perimetrical edge 36 of laminate 40. This relationship is indicated in FIG. 2.

Laminae 61 and 62 of back panel 22, FIG. 6, are the same size: width WW which is equal to the width of the front panel 21, FIG. 5, and length LB. Width WW is equal to the sum of the width of laminate 40*a* (W+two S) plus two times a distance E. The top edge of back panel 22 is designated 64, the side edges are designated 25*b* and 26*b*, and the bottom edge is designated 27*b*. The 2-ply portion comprising laminae 61 and 62 which extends between the upper edge of laminate 40*a* and edge 64 is designated flap 65.

The back panel 22, FIG. 6, is assembled as described hereinbefore with respect to front panel 21 except that laminate 40*a* is inwardly spaced a distance E from the side edges 25*b* and 26*b*, and a distance E upwardly from the bottom edge 27*b* of back panel 22. In the exemplary embodiment bag 20 referred to hereinbefore, S is about one-half (0.5) cm; E is about one (1) cm; and LB is about eight (8) cm greater than LF, FIG. 5.

Strap 23, FIG. 1, is preferably a sheet of flexible electrically insulative material—for instance, one-mil polypropylene—having a top-to-bottom dimension of from about three (3) cm to about eight (8) cm, and a side-to-side dimension (WW) of about thirty-three-and-one-half (33.5) cm.

The bag 20, FIGS. 1 and 2, is assembled by placing front panel 21, FIG. 5, on top of back panel 22, FIG. 6, so that edges 25*a*, 26*a*, and 27*a* of front panel 21 are juxtaposed edges 25*b*, 26*b*, and 27*b*, respectively, of the back panel 22. The strap 23 is then positioned so that its top edge 71 is adjacent to or slightly spaced below bar seal 55, and so that the oppositely disposed end edges of the strap are juxtaposed segments of side edges 25*a* and 26*a*. The adjacent juxtaposed edges are then sealed together by, for instance, a bar sealer to form side seams 25 and 26, and bottom seam 27. Thus assembled, the electrically insulative edge portions of width E, FIG. 2, provide means for spacing bag 20 from other such bags and/or the walls of a microwave oven, and/or other electrically conductive elements, members, portions, and the like of other cooking utensils and/or microwave energy cooking means. Such spacing provides reduced tendency for electrical arcing which, under some circumstances, can occur when electrically conductive materials are disposed in a field of microwave energy. Also, when the bag 20 is assembled as shown in FIG. 2 and described above, all of the adjacent side-by-side segments of the perimetrical edges 36 and 37 are offset a distance S so that edge-to-edge electric field relations are substantially obviated; that is, the spatial disposition of edge 36 to the surface of the electrically conductive lamina of laminate 40*a* establishes edge-to-surface electric field relations which have substantially less tendency to precipitate electrical arcing than edge-to-edge relations which arcing can, under some circumstances, occur as stated above.

Figure 7:
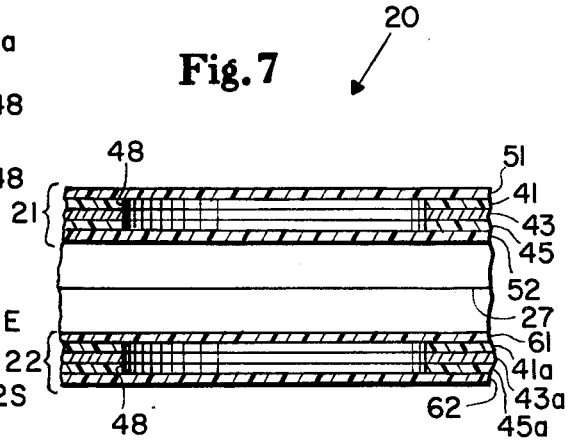
FIG. 7 is an enlarged scale, fragmentary sectional view taken along line 7—7 of FIG. 2.

FIG. 7 is an enlarged scale, fragmentary sectional view taken along line 7—7 of FIG. 2. This view shows the five principal plies of both the front panel 21 and back panel 22. This view also shows that apertures 48 extend through laminae 41, 43, and 45 of the front panel 21, and through laminae 41*a*, 43*a*, and 45*a* of back panel 22. FIG. 7 also shows that imperforate portions of laminae 51, 52, 61, and 62 span apertures 48. As described hereinbefore, laminae 41, 45, 41*a* and 45*a* of an exemplary embodiment of the present invention are optically opaque whereas laminae 51, 52, 61, and 62 are optically transparent. The opaque laminae provide means for obviating the high optical reflectance of the aluminum foil laminae 43 and 43*a*, and the transparent laminae form transparent windows through which a user of bag 20 can visually observe what is being cooked inside a bag 20. In embodiments of the invention where, for instance, the optical reflectance of the aluminum foil laminae 43 and 43*a* is not deemed to be a negative attribute, laminae 41, 45, 41*a* and 45*a* may be omitted.

To place a bag 20, FIG. 1, in operation for its intended use, material such as a beef roast to be cooked in a microwave oven (not shown) is placed in the bag. Then the bag is closed, preferably by folding both the front panel 21 and the back panel 22 along bar seal 55, and tucking the flaps 58 and 65 between the front panel 21 and the strap 23. Such a closure is sufficiently loose or open to obviate dangerous pressurization of the bag during a cooking cycle, yet it is sufficiently closed to retain inside the bag most of the moisture issuing from cooking comestible material therein. In the event additional venting and/or draining means are desired for certain applications, such means may be provided, for instance, by forming holes in the portions of the laminae 51, 52, 61, and 62 spanning apertures 48, as disclosed in the hereinbefore referenced and incorporated Continuation-In-Part Application Ser. No. 854,941 which was filed on Nov. 25, 1977.

Referring back to FIG. 5, front panel 21, and FIG. 6, back panel 22, the arrays of apertures 48 were described as being identical in an exemplary embodiment of the present invention. That is, the edges of the apertures 48 in the front panel 21 are in registered relation with respect to the edges of apertures 48 in the back panel 22; not offset as described above with respect to perimetrical edges 36 and 37. For most intended uses of bags 20, it is believed that offsetting the edges of apertures 48 is not necessary because the front panel 21 will be spaced from back panel 22 by the contents of the bag. However, for uses wherein the contents of the bag will not sufficiently space its front panel from its back panel, the edges of the apertures 48 can be offset by, for instance, providing alternately spaced large and small diameter apertures in the arrays and making the arrays complementary. That is, by providing alternately spaced large and small diameter apertures in the front panel 21 which are in registered relation with small and large diameter apertures, respectively, in the back panel 22.

While the preferred embodiment bag 20 of the present invention has been described as comprising laminated front and back panels, the term laminated is used in the broad sense to mean structures comprising multiple layers or plies which may be discrete layers which are bonded or heat sealed together, or may be built up by extrusion coating processes and the like. Moreover, whereas laminates 40 and 40*a* are punched with apertures 48, plain aluminum foils or the like (laminae 43 and 43*a*) can be punched and then coated with and/or bonded to electrical insulation material.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. In an improved microwave energy moderating cooking bag for enclosing foodstuff to be warmed or cooked uniformly in a microwave oven and which bag includes microwave energy moderating wall portions comprising perforated electrically conductive sheet material having perimetrical edges, said conductive sheet material being substantially fully perforated with a multiplicity of apertures of predetermined sizes with respect to a predetermined nominal frequency of microwave energy, the improvement wherein said electrically conductive sheet material is so configured and disposed that adjacent side-by-side segments of said perimetrical edges are sufficiently offset with respect to each other that edge-to-edge electric field relations are substantially obviated intermediate said adjacent side-by-side segments.

2. The improved microwave energy cooking bag of claim 1 wherein said electrically conductive sheet material is aluminum foil and said offset is in the range of from about three millimeters to about one-half wavelength of said microwave energy.

3. The improved microwave energy cooking bag of claim 2 wherein said offset is preferable about five millimeters.

4. The improved microwave energy cooking bag of claim 1 wherein said electrically conductive sheet material is perforated by an array of apertures and said bag further comprises means for having adjacent side-by-side edge portions of said apertures sufficiently offset with respect to each other to substantially obviate edge-to-edge electric field relations intermediate said adjacent side-by-side edge portions.

* * * * *